US005781216A

United States Patent [19]

Haruta et al.

[11] Patent Number: 5,781,216

[45] Date of Patent: Jul. 14, 1998

[54] INK-JET PRINTING CLOTH, TEXTILE PRINTING METHOD OF THE SAME AND PRINT RESULTING THEREFROM

[75] Inventors: Masahiro Haruta, Tokyo; Shoji Koike; Makoto Aoki, both of Yokohama; Koromo Shirota, Kawasaki; Aya Yoshihira, Yokohama; Tomoya Yamamoto; Mariko Suzuki, both of Kawasaki, all of Japan

[73] Assignee: Canon Kabushiki Kaisha, Tokyo, Japan

[21] Appl. No.: 548,621

[22] Filed: Oct. 26, 1995

[30] Foreign Application Priority Data

| | | | |
|---|---|---|---|
| Oct. 28, 1994 | [JP] | Japan | 6-265216 |
| Oct. 31, 1994 | [JP] | Japan | 6-266589 |
| Dec. 2, 1994 | [JP] | Japan | 6-299631 |

[51] Int. Cl.[6] ..... B41J 2/01

[52] U.S. Cl. ..... 347/106; 347/101

[58] Field of Search ..... 347/101, 105, 347/106

[56] References Cited

U.S. PATENT DOCUMENTS

| | | | |
|---|---|---|---|
| 4,702,742 | 10/1987 | Iwata et al. | 8/495 |
| 4,725,849 | 2/1988 | Koike et al. | 346/1.1 |
| 4,849,770 | 7/1989 | Koike et al. | 346/1.1 |
| 4,969,951 | 11/1990 | Koike et al. | 106/22 |
| 5,101,217 | 3/1992 | Iwata et al. | 346/1.1 |
| 5,124,718 | 6/1992 | Koike et al. | 346/1.1 |
| 5,250,121 | 10/1993 | Yamamoto et al. | 106/22 R |
| 5,396,275 | 3/1995 | Koike et al. | 347/101 |
| 5,468,553 | 11/1995 | Koike et al. | 428/224 |
| 5,500,023 | 3/1996 | Koike et al. | 8/499 |

FOREIGN PATENT DOCUMENTS

| | | |
|---|---|---|
| 0199874A1 | 11/1986 | European Pat. Off. . |
| 0212655A2 | 3/1987 | European Pat. Off. . |
| 0553761A1 | 8/1993 | European Pat. Off. . |
| 2521596A1 | 12/1976 | Germany . |
| 395985 | 4/1961 | Japan . |
| 46-40510 | 11/1971 | Japan . |
| 54-59936 | 5/1979 | Japan . |
| 60-134080 | 7/1985 | Japan . |
| 63-006183 | 1/1988 | Japan . |
| 63-31594 | 6/1988 | Japan . |
| 02300377 | 12/1990 | Japan . |
| 0435351 | 6/1992 | Japan . |
| 06184954 | 7/1994 | Japan . |

OTHER PUBLICATIONS

Derwent Pub. Database WPI, Sec. Ch., Week 8829 AN 86–115656 with respect to JP 63–031594 of Jun. 24, 1988.

Derwent Pub. Database WPI, Sec. Ch., Week 9519 AN 95–145422 with respect to JP 07–070950 of Mar. 14, 1995.

Derwent Pub. Database WPI, Sec. Ch., Week 9431 AN 94–253440 with respect to JP 6–184954 of Jul. 5, 1994.

*Primary Examiner*—Valerie Lund

*Attorney, Agent, or Firm*—Fitzpatrick, Cella, Harper & Scinto

[57] ABSTRACT

An ink-jet printing cloth is disclosed in which a selected type of polyethylene oxide is incorporated in specified amounts. The polyethylene oxide has a larger viscosity average molecular weight of from 100,000 to 3,000,000 and acts to pretreat a starting cloth material so as to be adequate for ink-jet printing. The ink-jet printing cloth is highly capable of providing images of great color depth with sufficient brightness and sharpness but freedom from an objectionable bleeding. Also disclosed are a textile printing method using that printing cloth and a print resulting from this method.

17 Claims, 2 Drawing Sheets

INK-JET PRINTING CLOTH, TEXTILE PRINTING METHOD OF THE SAME AND PRINT RESULTING THEREFROM

BACKGROUND OF THE INVENTION

1. Field of the Invention

This invention is directed to cloths suitable for use in an ink-jet system. The present invention is also directed to a textile printing method making use of such cloths and to prints obtained by that method.

2. Related Background Art

A variety of methods has been developed for the ink-jet printing of cloth materials. One such method is contrived to place a cloth in temporarily adhesive conditions on a flat, tacky and nonstretchable support, followed by printing with a printer as disclosed in Japanese Patent Application Laid-Open No. 63-6183. Japanese Patent Publication No. 63-31594 teaches a process of pretreating a cloth with an aqueous solution containing a water-soluble polymeric material incapable of being dyed with a dye to be used, a water-soluble base or a water-insoluble inorganic pulverizate and subsequently subjecting the cloth to ink-jet dyeing. In Japanese Patent Publication No. 4-35351, a fibrous cellulose is pretreated with an aqueous solution in which incorporated are an alkaline material, urea or thiourea, and a water-soluble polymeric material, followed by ink-jet dyeing with a reactive dye-containing ink and by heat fixing in dry conditions.

The foregoing methods of the prior art are directed toward preventing image bleeding and providing sharp patterns and prints of high color brightness and color depth. However, the depth and brightness qualities attained by such prior art methods are not comparable to, or not better than, those made available by conventional textile printing methods such as screen printing. Other problems with the prior art methods are that a poor ink penetration to the cloth in its direction of thickness invites an insufficient color depth and an objectionable bleeding in case of increased ink intake, thus leading to limited application of the resulting print.

SUMMARY OF THE INVENTION

One object of the present invention, therefore, is to provide an ink-jet printing cloth which is highly capable of forming images of high color depth with a sufficient brightness and sharpness, and substantially free from bleeding even when ink intake is larger.

Another object of the present invention is to provide a textile printing method using such cloth.

A further object of the present invention is to provide a print resulting from such method.

The above objects can be achieved by the present invention.

In one important aspect of the present invention, there is provided an ink-jet printing cloth containing a polyethylene oxide having a viscosity average molecular weight of not less than 100,000 in an amount of from 0.1 to 30% by weight.

In a further aspect, the present invention provides a textile printing method which comprises incorporating into a cloth a polyethylene oxide having a viscosity average molecular weight of not less than 100,000 in an amount of from 0.1 to 30% by weight; applying to the resultant cloth an ink by an ink-jet system; and subjecting the cloth to a fixing treatment; and washing and drying the cloth.

In still another aspect, the present invention provides an ink-jet printing cloth containing a polyethylene oxide having a viscosity average molecular weight of not less than 100,000 in an amount of from 0.1 to 30% by weight and a boehmite-based particulate alumina having an average primary particle size of from 10 to 20 mμ and a specific gravity of from 1.17 to 1.20 in an amount of from 0.5 to 10% by weight.

In still another aspect, the present invention provides a textile printing method comprising incorporating into a cloth a polyethylene oxide having a viscosity average molecular weight of not less than 100,000 in an amount of from 0.1 to 30% by weight and a boehmite-based particulate alumina having an average primary particle size of from 10 to 20 mμ and a specific gravity of from 1.17 to 1.20 in an amount of from 0.5 to 10% by weight; applying to the resultant cloth an ink by an ink-jet system; subjecting the cloth to a fixing treatment; and washing and drying the cloth.

In still another aspect, the present invention provides an ink-jet printing cloth containing a polyethylene oxide having a viscosity average molecular weight of not less than 100,000 in an amount of from 0.1 to 30% by weight, and a repellent in an amount of from 0.05 to 40% by weight.

In still another aspect, the present invention provide a textile printing method comprising: incorporating into a cloth a polyethylene oxide the resin having a viscosity average molecular weight of not less than 100,000 in an amount of from 0.1 to 30% by weight, and a repellent in an amount of from 0.05 to 40% by weight; applying to the resultant cloth an ink by an ink-jet system; subjecting the cloth to a fixing treatment; and washing and drying the cloth.

In another aspect, the present invention provides a textile printing method which comprises applying to the above mentioned cloths an ink by an ink-jet system; subjecting the cloths to a fixing treatment; and washing and drying the cloths.

DETAILED DESCRIPTION OF THE PREFERRED EMBODIMENTS

Figure 1:
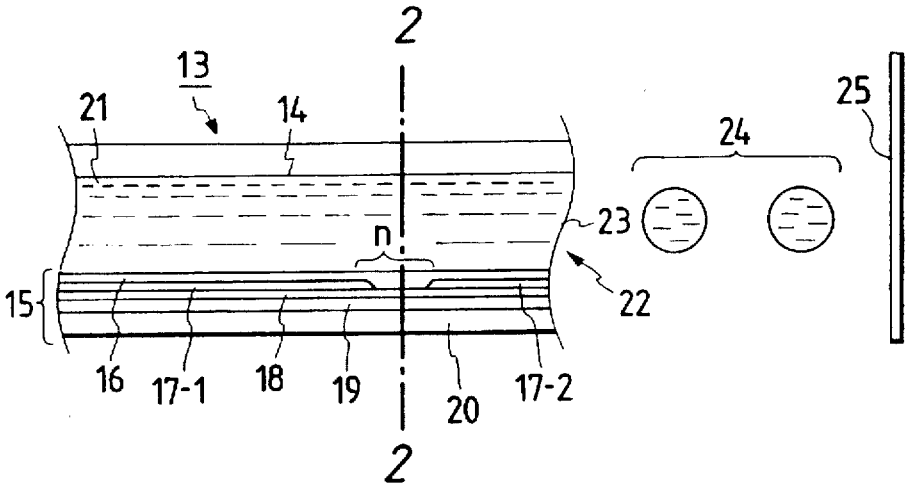
FIG. 1 is a longitudinal cross-sectional view illustrative of a head portion of the ink-jet printing apparatus employed in the present invention.

Cloth materials eligible for the present invention are cotton, silk, hemp, nylon, rayon, acetate, polyester and combinations thereof. The cloths require a treatment, depending upon their nature, for varying pH parameters of treating agents. For instance, the cotton, silk and rayon materials are controlled at an alkaline pH side with sodium bicarbonate or sodium carbonate to suit printing with a reactive dye, while the nylon material is adjusted to an acidic side so as to be printed with an acid dye. In case of acetate and polyester materials it is preferable to use a pH value of a near neutral region.

According to the present invention, polyethylene oxide should importantly be employed to pretreat a starting cloth in order to gain a bleeding-free image with a high color depth on the cloth. To this end, the polyethylene oxide should have a viscosity average molecular weight of not less than 100,000 and should be incorporated in an amount of from 0.1 to 30% by weight into the cloth.

Through continued research leading to the present invention, it has been found that the polyethylene oxide has the ability to absorb and retain a large quantity of an ink and to keep the so much shot-in ink from getting diffused, thus preventing an image bleeding and a color mixing along a pattern edge portion, and that such resin further acts to prevent the tendency of a dye to diffuse toward a cloth surface during fixing treatment as by steaming, thereby freeing from an image bleeding while in a fixing treatment. These beneficiary effects are believed attributed to the fact that, because of its extremely large molecular weight and good compatibility with inks, the polyethylene oxide according to the present invention when admixed with an ink would render the latter less diffusive and hence prevent bleeding and color mixing at a pattern edge. Moreover, the polyethylene oxide by nature undergoes melt softening and has weak dyeability with dyes at a temperature of fixing treatment, so that an image bleeding would presumably be prevented during fixing treatment by hot steam. The effects noted above are conspicuous particularly in a water-insoluble disperse dye-based ink. The reason is that such a disperse dye-based ink is rich in a dispersant which, when combined with the polyethylene oxide, is presumed to form an insoluble complex. The larger molecular weight, the more the resin is effective for reduced fluidity where a plurality of inks are admixed together, and the higher the resin is in its melt-softening viscosity. This contributes greatly to enhanced effects accruing from the present invention.

The polyethylene oxide useful for the purpose of the present invention should have a viscosity average molecular weight of not less than 100,000, preferably not less than 200,000, more preferably not less than 500,000, but of not more than 3,000,000. In case that a molecular weight is not more than 100,000, the effect of the present invention cannot be obtained, while if it exceed 3,000,000, an irregular coating tends to occur since the resulting solution is too viscous.

The viscosity average molecular weight used here is calculated by the Mark-Houwink equation measured from a limited viscosity of a resin. The numerical value so obtained is said to be near to that of a weight average molecular weight commonly accepted in the art.

The amount of the polyethylene oxide to be incorporated into a cloth is in the range of from 0.1 to 30% by weight, preferably from 0.5 to 25% by weight. The resin of a too large molecular weight provides an too viscous aqueous solution, hence making it difficult to pretreat the cloth with a uniform amount of the resin and requiring viscosity reduction of the treating solution.

For example, the content of the resin in the treating solution is preferably from 2 to 20% by weight in case of a molecular weight of not more than 1,000,000 and from 0.5 to 2% by weight in case of a molecular weight of not less than 1,000,000.

When the polyethylene oxide having a larger molecular weight is used at a higher concentration, an inorganic salt is added to decrease the viscosity of the resulting treating solution. Examples of the inorganic salts are potassium sulfate, sodium sulfate, magnesium sulfate, potassium fluoride, potassium chloride, potassium bromide, potassium iodide and the like. Alkaline agents can also be used, examples of which include alkaline metal salts, ammonium salts, triethylamine salts and triethanolamine salts of each phosphoric acid, boric acid, silicic acid, acetic acid, carbonic acid, citric acid, tartaric acid, maleic acid and phthalic acid, and sodium hydroxide, triethanolamine and the like.

To attain uniformity of the coat amount, there can also be used urea, thiourea, tannic acid, lignin sulfonic acid, a chelating agent such as a sodium salt of ethylene diamine tetraacetate or the like, a water-soluble resin such as starch, methyl cellulose, carboxymethyl cellulose, polyvinyl alcohol, polyvinyl pyrrolidone, polyethylene imine, polyacryl amine or the like, or a cationic polymer.

Each of the salts and ureas exemplified above is added in an amount of from 1 to 30% by weight, preferably from 1 to 20% by weight, more preferably from 1 to 10% by weight, based on the total weight of the treating solution. The water-soluble resin is added preferably in an amount of from 0.5 to 20% by weight, the cationic polymer in an amount of from 0.01 to 3% by weight and the alkaline agent in an amount of from 0.1 to 5% by weight.

In the practice of the present invention, an inorganic pigment can preferably be used in combination with the polyethylene oxide to thereby achieving an improved coloring ability of images. This pigment includes for example silica, alumina, talc, kaolin, bentonite, calcium carbonate, zeolite, synthetic mica and the like, among which alumina is preferred, particularly a boehmite-based particulate alumina having an average primary particle size of from 10 to 20 mμ and a specific gravity of from 1.17 to 1.20.

Even when dispersed in a larger quantity in water or the like, the boehmite-based particulate alumina according to the present invention is less viscous than an amorphous feathery alumina and hence easy to handle.

Suitable examples of such particulate alumina are typified by Alumina Sol-520 (trade name, average primary particle size of from 10 to 20 mμ, and specific gravity of from 1.17 to 1.20, manufactured by Nissan Kagaku K.k). Other grades of boehmite-based aluminas and alumina sols can also be utilized which serve to retain a dye in the ink at a region adjacent to a surface of the cloth, thus producing an improved color depth. The alumina sol when used alone, however, involves bleeding owing to its inability to absorb and hold the ink.

The polyethylene oxide used in the present invention is such resin that is not only free from viscosity buildup and gelation when mixed with a dispersion of the above specified alumina, but also capable of ink retention and bleeding prevention. This means that use of such resin combined with such alumina is conducive, to a greater extent, to those effects afforded by the present invention.

Japanese Patent Application Laid-Open No. 6-184954 discloses a cloth containing an alumina boehmite sol. This known cloth, however, has incorporated therein the alumina boehmite material in permanently adherent manner, the alumina boehmite thus united with the cloth absorbs a dye in an ink-jet ink, causing the dye to color with a high color depth. The alumina boehmite according to the present invention is removed by washing after coloration is completed. In this respect, the present invention is distinct from the disclosure just cited.

In Japanese Patent Application Laid-Open No. 2-300377, an ink-jet printing method is taught which employs a cloth pretreated with silica and alumina having a particle size of from 0.2 to 10 μm. This prior art technique intends to increase ink absorptivity taking advantage of the porous nature of silica and alumina, thereby preventing bleeding. On the contrary, in the present invention the boehmite-based alumina adsorbs and retains a dye on a cloth surface, thereby improving a coloring ability, but does not act to alleviate bleeding. To compensate for this, the present invention uses the above specified polyethylene oxide to hold an ink and thus free from bleeding. Thus, in view of the mechanism for eliminating bleeding, the present invention is distinguished from the second publication cited here.

The amount of the alumina to be incorporated with a cloth is in the range of from 0.5 to 10% by weight, preferably from 1 to 10% by weight. Smaller amounts than 0.5% by weight would not be effective for improving a coloring ability. Larger amounts than 10% by weight would become maximum in improving a coloring ability and conversely pose image bleeding during a fixing treatment.

The ratio of alumina to polyethylene oxide ranges, on a weight basis, from 20:1 to 1:10, preferably from 15:1 to 1:5. More an amount of alumina beyond that range would be insufficient to prevent bleeding, whereas more an amount of polyethylene oxide beyond that range would produce no better results as to a coloring ability.

According to another preferred embodiment of the present invention, a repellent can be employed together with the polyetylene oxide so as to further enhance a coloring ability of images, in particular, sharpness of tone remarkably at mixed portions of two or more colors.

The repellent used here is hydrophobic in nature, and whatever materials if they dislike or repel water may be suitable for the present invention. Examples of the repellent include fluorine type compounds, paraffin type compounds, silicon type compounds, waxes, triazine type compounds, rosin type sizing agents for paper use and combinations thereof. Particularly preferred among them are fluorine type compounds, waxes and rosin type sizing agents since they are noticeably capable of preventing bleeding and improving a color depth.

The polyethylene oxide according to the present invention involves neither viscosity buildup nor gelation when mixed with the above repellent, contributing to sufficient ink retention and freedom from bleeding.

The amount of the repellent to be incorporated with a cloth is in the range of from 0.05 to 40% by weight, preferably from 0.1 to 30% by weight. Less than 0.05% by weight would fail to provide a sufficient coloring ability. More than 40% by weight would adversely affect coloring ability and, what is worse, result in reduced ink absorptivity, hence bleeding.

The ratio of a repellent to a polyethylene oxide is from 20:1 to 1:20 by weight, preferably from 10:1 to 1:10 by weight.

More an amount of a repellent above that range would not sufficiently prevent ink bleeding, while more an amount of a polyethylene oxide above that range would be ineffective in improving a coloring ability any further.

In the system where the polyethylene oxide is used together with the repellent, a toluene sulfonamide derivative can be added to prevent bleeding during a fixing treatment and to further improve a color depth. This derivative may be selected for example from p-toluene sulfonamide, N,N-dihydroxyethyl-p-toluene sulfonamide, N-ethyl-p-toluene sulfonamide, N-phenyl-p-toluene sulfonamide and the like. To be more specific, they are the compounds of the formula

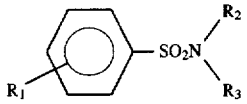

(A)

where $R_1$ is hydrogen, or an alkyl group represented by the formula $C_nH_{2n+1}$ where n is an integer of 1 or 2, hydroxyl or carboxyl, and $R_2$ and $R_3$ each independently are hydrogen, a hydroxyalkyl group having 2 to 4 carbon atoms, a dihydroxyalkyl group having 3 or 4 carbon atoms, a group represented by the formula $—(CH_2CH_2O)_mH$ where m is an integer of 1 to 5, or an alkyl group represented by the formula $C_nH_{2n+1}$ where n is an integer of 1 or 2.

The following compounds are specific examples of those represented by the Formula (A).

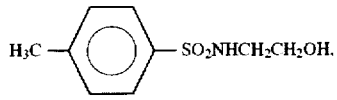

(1)

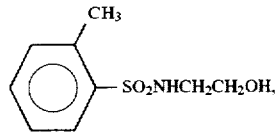

(2)

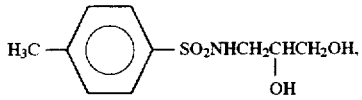

(3)

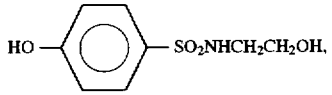

(4)

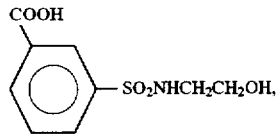

(5)

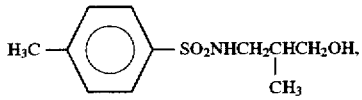

(6)

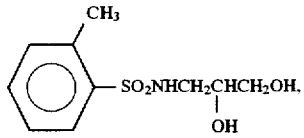

(7)

and

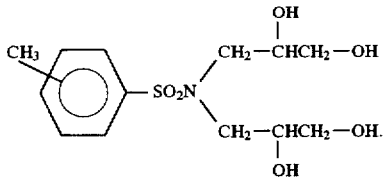

(8)

In the present invention, a cloth pretreatment can be conducted with a cationizing agent to thereby enhance a coloring ability of images. Generally, the cationizing agent is used to improve a color yield of an anionic dye and applied mainly to cotton and rayon to modify them for dyeing with an acid dye and for increasing a color yield of a reactive dye. Examples of such cationizing agents and details of the treating method are disclosed in Japanese Patent Publications No. 39-5985 and No. 46-40510 and Japanese Patent application Laid-Open No. 60-134080.

For instance, a cloth may be contacted, as by coating or impregnation, with a solution containing either one of the compounds shown hereunder and thereafter cured by heat, followed by washing with water and drying so that a cationic material-incorporated cloth is obtained. Though dependent on the treating method employed and the kind of cloths used, the amount of the cationizing agent to be used is preferably from about 0.01 to 30% by weight based on the total weight of the cloth.
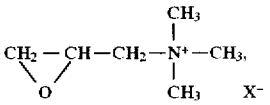
(1)
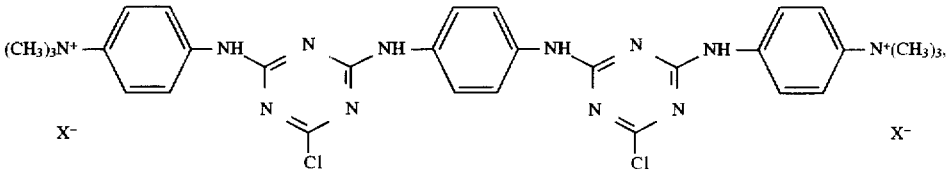
(2)
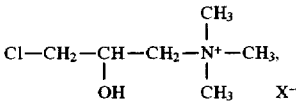
(3)
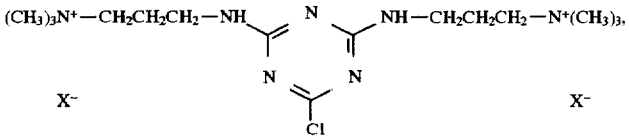
(4)
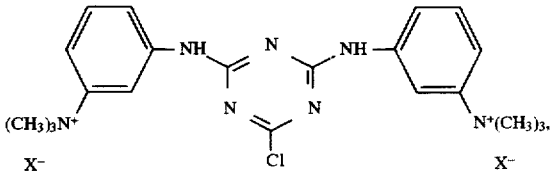
(5)
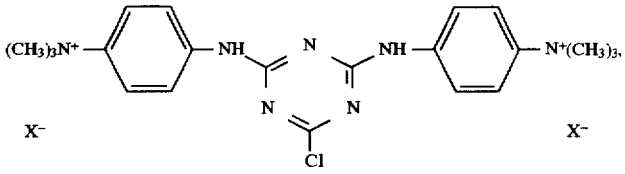
(6)
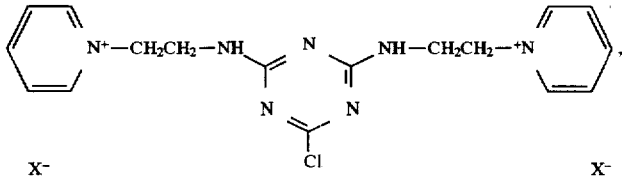
(7)
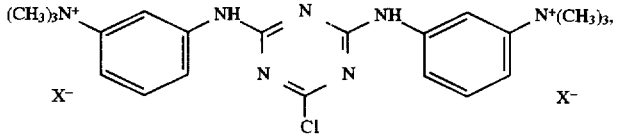
(8)
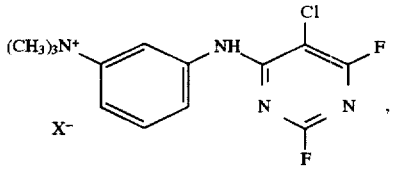
(9)

-continued

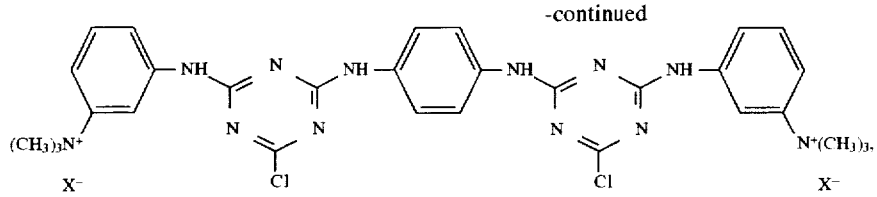

(10)

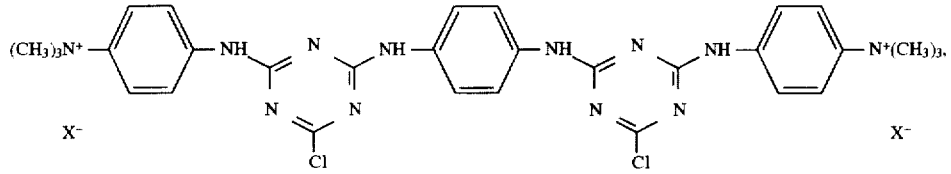

(11)

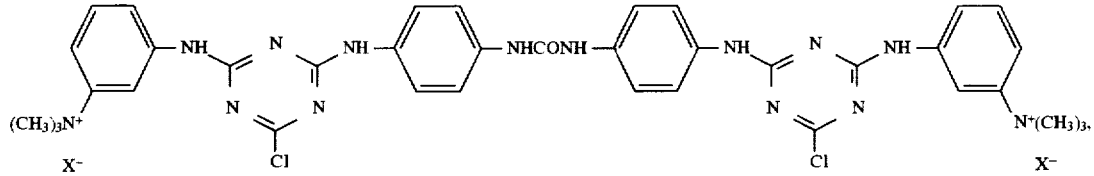

(12)

and

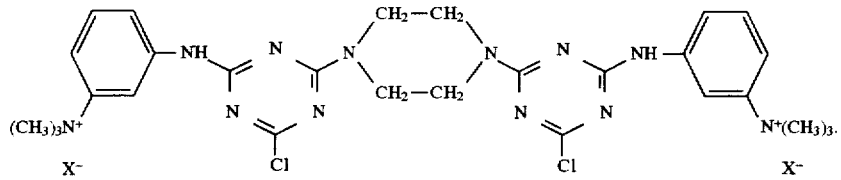

(13)

In the above formulae, X is halogen such as chlorine, fluorine and the like.

To the above cationizing agent may if necessary be added various additives which are selected, for example, from penetrants, water-dispersive polymers, water-soluble solvents such as glycols and the like, and antireductants such as sodium m-nitrobenzene sulfonate and the like.

Such treating agent can be incorporated with a cloth by coating, impregnation or spraying of an aqueous solution or dispersion of that agent.

A method for ink-jet printing of the present invention in which the cloth specified hereinbefore is used will now be described.

Eligible inks may be any ink comprising a reactive dye, an acid dye, a direct dye and a disperse dye. Any suitable one may be chosen, depending upon the kind of cloths to be printed. Most preferred is the textile printing of acetate, polyester and a newly developed grade of polyester in particular with the use of a disperse dye-based ink.

Textile printing can be performed with an ink-jet printing head disposed to scan the cloth of the present invention and to impart an ink to a cloth region corresponding to an image. The resulting cloth may subsequently be subjected, where desired, to a fixing treatment with heat, followed by washing and drying.

In conducting the fixing treatment with heat, any known modes of a treatment accepted in conventional textile printing processes may be utilized as such; that is, high temperature-steaming and thermosol modes are applicable. Although the treatment conditions vary with the kind of cloths, cotton and silk may be dyed with a reactive dye ink at from 100° to 105° C. for 5 to 30 minutes by the high temperature mode. Polyester may be dyed with a disperse dye-based ink at from 160° to 180° C. for several minutes to tens of minutes by the high temperature-steaming and at from 190° to 230° C. for several seconds to tens of seconds by the thermosol mode.

Subsequently to the fixing treatment, a washing step may be done generally by washing with water and by soaping with an aqueous solution containing an alkaline agent. In general, polyester may follow washing with water, then reductive washing with an aqueous solution containing an alkaline agent and a hydrosulfide compound and again washing with water.

Ink-jet printing inks useful in the present invention may include, as ingredients, dyes, water, water-soluble organic solvents, pH regulators, antiseptic agents, surfactants, dispersants, water-soluble resins and the like. The dyes are chosen from acid dyes, direct dyes, basic dyes, reactive dyes, disperse dyes and pigments. The water-soluble organic solvents are, for example, glycols, glycol ethers, nitrogen-containing solvents, alcohols and the like, and the surfactants are those of a nonionic, anionic, cationic or amphoteric type that are selective according to the purposes of application. Hydrotropic agents such as ureas may also be used.

Disperse dye-based inks are formulated essentially with dispersants, examples of which include lignin sulfonate salts, condensates of naphthalene sulfonate with formalin, polyoxyethylene monophenylethers and the like.

The inks for the ink-jet printing method of the present invention comprise as the essential liquid ingredient. This liquid ranges in amount from 30 to 90% by weight, preferably from 40 to 90% by weight, more preferably from 50 to 85% by weight, based on the total weight of the ink.

The essential ingredients of the ink-jet printing inks according to the present invention are as stated above. Organic solvents in common use can be added as liquid media to those inks. The solvents are chosen, for example, from ketones and ketone alcohols such as acetone, diacetone alcohol and the like, ethers such as tetrahydrofuran, dioxane and the like, addition polymers of oxyethylene or oxypropylene such as diethylene glycol, triethylene glycol, tetraethylene glycol, dipropylene glycol, tripropylene glycol, polyethylene glycol, polypropylene glycol and the like, alkylene glycols having an alkylene moiety of 2 to 6 carbon atoms such as ethylene glycol, propylene glycol, trimethylene glycol, butylene glycol, hexylene glycol and the like, triols such as 1,2,6-hexane triol and the like, lower alkyl ethers of polyhydric alcohols such as thiodiglycol, glycerin, ethylene glycol monomethyl (or monoethyl) ether, diethylene glycol monomethyl (or monoethyl) ether, triethylene glycol monomethyl (or monoethyl) ether and the like, lower dialkyl ethers of polyhydric alcohols such as triethylene glycol dimethyl (or diethyl) ether, tetraethylene glycol dimethyl (or diethyl) ether and the like, sulfolane, N-methyl-2-pyrrolidone, 1,3-dimethyl-2-imidazolidinone and the like.

A content of the above organic solvent in the ink is in the range of from 3 to 60% by weight, preferably from 5 to 50% by weight, based on the total weight of the ink.

The organic solvents listed above may be used singly or in combination. Most preferred is a liquid medium containing at least one polyhydric alcohol, an example of which is thiodiglycol alone or a mixture of diethylene glycol and thiodiglycol.

The ink-jet printing method of the present invention is a method constituted to provide printing on the ink-jet printing cloth of the present invention using a given printing ink of the above specified class. As an ink-jet printing system for use in the method of the present invention, there may be employed any known ink-jet printing systems. However, most preferred is a system as disclosed for instance in Japanese Patent Application Laid-Open No. 54-59936 in which thermal energy is applied to an ink to thereby cause the latter to rapidly change in its volume and to eject an ink from an orifice by the action of that volume change. By printing in such system, the ink-jet printing cloth of the present invention is highly capable of stable printing.

To obtain prints with noticeably enhanced effects, printing conditions should preferably be set at an ink droplet ejection of from 20 to 200 pl, an ink shot-in quantity of from 4 to 40 $nl/mm^2$, a drive frequency of not less than 1.5 kHz and a head temperature of from 35° to 60° C.

A preferred form of an apparatus for use in conducting a textile printing by the use of the ink-jet printing cloth of the present invention may be structured to apply thermal energy corresponding to printing signals to an ink in a printing head, thereby generating ink droplets through that thermal energy.

Figure 2:
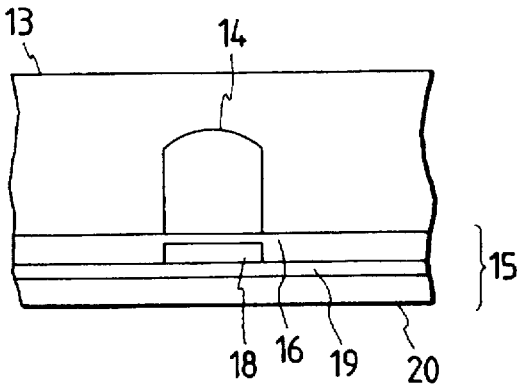
FIG. 2 is a transverse cross-sectional view of the head portion of FIG. 1 taken along the line 2—2.
Figure 3:
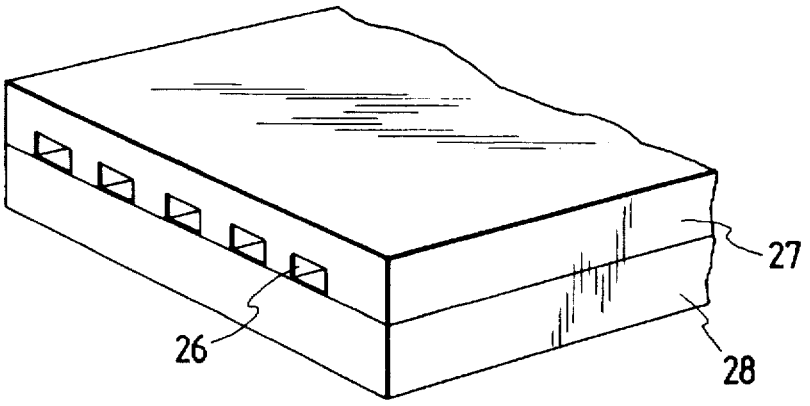
FIG. 3 is a perspective view illustrating a multi-head that is composed of an array of heads as shown in FIG. 1.

Examples of a head that is a main component of such apparatus are shown in FIGS. 1, 2 and 3.

A head 13 is assembled by bonding a glass, ceramic or plastic plate having a groove 14 for passage of an ink, onto a heating head 15 which can used for thermal printing (the head shown in the drawing is illustrative, but the present invention is not restrictive). The heating head 15 is composed of a protective film 16 made, for example, of silicon oxide, aluminum electrodes 17-1 and 17-2, a heating resistor layer 18 made as of nichrome, a heat accumulating layer 19 and a substrate 20 made of alumina or the like having good heat radiation.

An ink 21 comes up to an ejection orifice 22 (a minute opening) and forms a meniscus 23 due to a pressure P.

Now, upon application of electric signals to the electrodes 17-1 and 17-2, the heating head 15 rapidly generates heat at its region designated at n and forms bubbles in the ink 21 located in contact with that region. The meniscus 23 of the ink 21 is projected by the action of the pressure so produced, and the ink 21 is ejected in the form of printing droplets 24 from the orifice 22 to a cloth 25 of the present invention.

FIG. 3 shows the appearance of a multi-head composed of an array of a number of heads as illustrated in FIG. 1. The multi-head is formed by bringing a glass plate 27 provided with a number of channels 26 into intimately adhesive contact with a heating head 28 similar to that of FIG. 1. Note that FIG. 1 cross-sectionally shows the head 13 taken along the flow path of the ink, and FIG. 2 is a cross-sectional view taken along the line 2—2.

Figure 4:
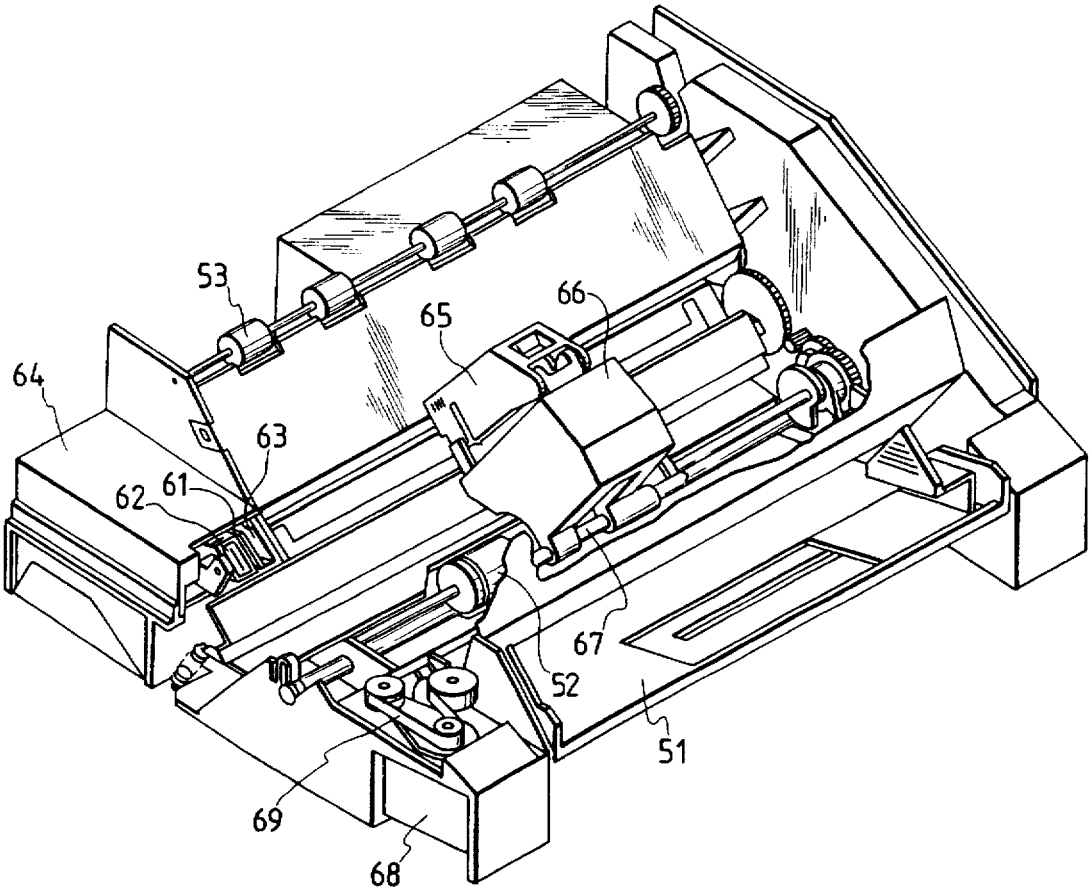
FIG. 4 perspective view illustrative of an ink-jet printing apparatus used in the present invention.

FIG. 4 illustrates an ink-jet printing apparatus having such a head incorporated therein.

In FIG. 4, reference numeral 61 is a blade serving as a wiping member, one end of which is a stationary end held by a blade-holding member and acting as a cantilever. The blade 61 is disposed at a position adjacent to a region in which a printing head operates, and in this embodiment, the blade 61 is held in such that it protrudes into a path through which the printing head moves. Reference numeral 62 is a cap located at a home position adjacent to the blade 61 and moving in the direction perpendicular to the direction in which the printing head moves, thus coming into contact with the face of ejection openings to cap the latter. Reference numeral 63 indicates an absorbing member placed in proximity to the blade 61 and, similar to the blade 61, held such that it protrudes into the path through which the printing head moves. The blade 61, cap 62 and absorbing member 64 constitute an ejection-recovery portion 64 where the blade 61 and absorbing member 63 remove water, dust and the like from the face of the ink-ejecting openings.

Reference numeral 65 is a printing head having an ejection-energy-generating means and acting to eject the ink onto a cloth disposed in opposed relation to the ejection opening face having ejection openings, thus conducting printing. Reference numeral 66 denotes a carriage on which the printing head 65 is movably mounted. The carriage 66 is slidably interengaged with a guide rod 67 and interconnected (not shown) at a portion thereof to a belt 69 driven by a motor 68. Thus, the carriage 66 can move along the guide rod 67, and hence, the recording head 65 can move from a printing region to a region adjacent thereto.

Reference numerals 51 and 52 are a cloth feeding part from which the cloths are separately inserted, and cloth feed rollers driven by a motor (not shown), respectively. With this construction, the cloth is fed to the position opposite to the ejection opening face of the printing head and discharged from a cloth discharge section provided with cloth discharge rollers 53 as printing progresses.

The cap 62 in the head recovery portion 64 detracts from the moving path of the printing head 65 when the latter head returns to its home position, for example, after completion of the printing, while the blade 61 remains protruded into the moving path. As a result, the ejection opening face of the printing head 65 is wiped. When the cap 62 comes into contact with the ejection opening face of the printing head 65 to cap that face, the cap 62 moves to protrude into the moving path of the printing head.

When the printing head 65 moves from its home position to a position in which to start printing, the cap 62 and blade 61 are at the same position as that in which wiping is done as stated above. Hence, during this movement of the printing head 65, the ejection opening face of the head 65 is also wiped. The movement of the printing head to its home position is made not only when printing is completed, or the head is recovered from ejection, but also when the head is moved between the printing regions for printing, during which it is moved to the home position adjacent to each printing region at a given interval. This movement permits wiping of the ejection opening face.

The ink-jet printing cloth thus printed is heated where desired and washed with water, followed by peeling from the substrate and by subsequent drying, after which a print is obtained. Peeling may be done after drying.

The resulting print is severed into desired sizes, and cut pieces are then subjected to process steps required to provide final processed articles, such as sewing, bonding or welding, thus obtaining the products such as neckties, handkerchiefs or the like.

The following examples are given to explain the present invention in greater detail. In these Examples and Comparative Examples all percentages and parts are by weight unless otherwise noted.

EXAMPLE 1

A cotton cloth (thickness: 250 μm) treated with trimethyl-2-hydroxy-3-chloropropylammonium chloride as a reactive quaternary amine compound was impregnated (a pickup of 80%) with an aqueous solution to which had been added 2.0% of a polyethylene oxide (Alcox E-60, a trade name, viscosity average molecular weight of from 1,000,000 to 1,200,000, available from Meisei Kagaku K.K.), 1.0% of sodium citrate and 2% of urea, followed by drying, after which there was obtained a cloth according to the present invention. After being cut to a A4 size, the cloth was multicolor printed by a commercially available ink-jet color printer (BJC-820J, trade name, available from Canon Inc.) filled with an ink details of which were listed below. Immediately after the printing, the cloth was steam heated at 102° C. for 8 minutes, fully washed with an aqueous solution of 0.1% sodium dodecylbenzene sulfate and finally dried. The resultant cotton cloth revealed a bright color image. The image was sharp without smudge in the ink-free white background.

EXAMPLE 2

A 200 μm-thick plain-weave cotton cloth was impregnated (a pickup: 80%) with an aqueous solution containing 1.0% of a polyethylene oxide (Alcox E-75, trade name, viscosity average molecular weight of from 2,000,000 to 2,500,000), 3% of potassium chloride and 3% of sodium hydrogencarbonate, followed by drying and severing to a A4 sheet. Color printing was conducted by a commercially available ink-jet color printer (BJC-820, Canon Inc.) with an ink shown hereunder. Immediately after the printing, the cloth was caused to color with steam at 102° C. for 8 minutes, washed with water and dried. A bright color image was printed on the cloth. Also, there was no difference between color densities on both the front and back sides of the cloth and a sharp image could be obtained.

Ink Formulation

| | |
|---|---|
| cyan ink | |
| C.I. Reactive Blue 15 | 12 parts |
| Thiodiglycol | 22 parts |
| Ethylene glycol | 13 parts |
| Ion-exchange water | 53 parts |
| magenta ink | |
| C.I. Reactive Red 26 | 11 parts |
| Thiodiglycol | 22 parts |
| Diethylene glycol | 13 parts |
| Ion-exchange water | 54 parts |
| yellow ink | |
| C.I. Reactive Yellow 95 | 10 parts |

-continued

| | |
|---|---|
| Thiodiglycol | 22 parts |
| Diethylene glycol | 13 parts |
| Ion-exchange water | 55 parts |
| black ink | |
| C.I. Reactive Black 39 | 9 parts |
| Thiodiglycol | 22 parts |
| Ethylene glycol | 13 parts |
| Ion-exchange water | 56 parts |

Each of four different inks was mixed with stirring, and the mixture was adjusted to pH 7.0 with sodium hydroxide and filtered with Fluoropore Filter (tradename, manufactured by Sumitomo Electric Co.).

EXAMPLE 3

By pad treatment (a pickup: 70%) with an aqueous solution containing 1.0% of a polyethylene glycol (Alcox E-100, trade name, viscosity average molecular weight of from 2,500,000 to 3,000,000) and 2% of sodium sulfate, a 200 μm-thick polyester cloth was prepared and cut to a 42 cm-width roll. Full color printing was conducted by a commercially available ink-jet color printer (BJC-440, trade name, available from Canon Inc.) with an ink shown below. Immediately after the printing, a printed portion was cut out of the cloth and allowed to form coloration with superheated steam at 180° C. for 5 minutes. Subsequently, reductive washing was done with a hydrosulfide-containing alkaline solution, followed by washing with water and drying. A color image was produced on the cloth brightly. The image was highly sharp without smudge in the ink-free white background. Also, there was no difference between color densities on both the front and back sides of the cloth and a sharp image could be obtained.

Ink Formulation

| | |
|---|---|
| cyan ink | |
| C.I. Disperse Blue 87 | 7 parts |
| Lignin sodium sulfonate | 1 part |
| Thiodiglycol | 15 parts |
| Triethylene glycol | 15 parts |
| Ion-exchange water | 62 parts |
| magenta ink | |
| C.I. Disperse Red 92 | 6 parts |
| Lignin sodium sulfonate | 1 part |
| Thiodiglycol | 15 parts |
| Triethylene glycol | 15 parts |
| Ion-exchange water | 63 parts |
| yellow ink | |
| C.I. disperse Yellow 93 | 6 parts |
| Lignin sodium sulfonate | 1 part |
| Thiodiglycol | 15 parts |
| Triethylene glycol | 15 parts |
| Ion-exchange water | 63 parts |
| black ink | |
| C.I. Disperse Black 1 | 8 parts |
| Lignin sodium sulfonate | 1 part |
| Thiodiglycol | 15 parts |
| Triethylene glycol | 15 parts |
| Ion-exchange water | 61 parts |

The above components were dispersed and mixed with a sand grinder, and the mixture was filtered on a filter.

EXAMPLE 4

By pad treatment (a pickup: 90%) with an aqueous solution containing a polyethylene oxide (Alcox E-75, trade name), a dry polyester cloth made of a new synthetic fiber class of polyester was formed and treated in the same manner as in Example 3, thereby providing a print. A bright color image was produced on the cloth. The image was sharp on both of two surfaces of the cloth without smudge in the ink-free white background.

EXAMPLES 5 to 9

The procedure of Example 4 was followed except that the polyethylene oxide solution was replaced with different pretreating solutions according to the present invention shown in Table 1. The results are also shown in Table 1 together with those obtained for Comparative Examples 1 and 2.

In the following Tables 1 to 3, the sharpness, the color depth and the brightness at two colors-mixed region on the cloth were evaluated and ranked in accordance with the following standards.

Sharpness:

AA: Not bleeded, and no color-mixed portion along pattern edges.

A: Not bleeded, but a trace of occurrence of a color-mixed portion along pattern edges at a region where a larger amount of the ink was present.

B: Not bleeded, but slight occurrence of a color-mixed portion along pattern edges at a region.

C: Substantially bleeded, and appreciable occurrence of a color-mixed portion along pattern edges.

Color depth:

AA: Colored brightly with a sufficient color depth.

A: Colored brightly and deeply.

B: Colored brightly, but not deeply.

C: Colored dully and obscurely.

Brightness at two colors-mixed region:

AA: Colored especially brightly.

A: Colored brightly.

B: Colored not so brightly.

C: Colored dully.

TABLE 1

| No. | Ingredient in Treating Solution | Sharpness | Color Depth |
|---|---|---|---|
| Example 5 | Alcox R-150 10% (molecular weight: $10 \times 10^4 - 17 \times 10^4$) | A | A |
| Example 6 | Alcox R-1000 5% (molecular weight: $25 \times 10^4 - 30 \times 10^4$) | AA | A |
| Example 7 | Alcox E-45 2% (molecular weight: $60 \times 10^4 - 80 \times 10^4$) | AA | A |
| Example 8 | Alcox E-100 0.5$ (molecular weight: $200 \times 10^4 - 300 \times 10^4$) | AA | A |
| Example 9 | Alcox R-1000 5% alumina (boehmite) | AA | AA |
| Comparative Example 1 | polyvinyl pyrrolidone K30 6% (molecular weight: $8 \times 10^4$) | C | B |
| Comparative Example 2 | polyethylene glycol 10% (molecular weight: 6,000) | C | C |

Comparative Example 3

The procedure of Example 2 was followed except that 0.1% of sodium alginate having a molecular weight of 90,000 was used in place of the polyethylene oxide. The resulting cloth produced a bright color image, but failed to gain a sharp image with a high color depth.

EXAMPLE 10

A cotton cloth (thickness: 250 μm) was impregnated (a pickup: 80%) with an aqueous solution containing 2.0% of a polyethylene oxide (Alcox E-60, trade name, molecular weight: 1,000,000), 0.2% of urea, 2.0% of sodium carbonate and 6% of Alumina Sol-520, followed by drying, after which there was obtained a cloth according to the present invention. The resulting cloth contained 4.8% of alumina, 1.6% of polyethylene oxide, 0.16% of urea and 1.6% of sodium carbonate. The cloth was cut to an A4 size and multicolor printed as in Example 1. Immediately after the printing, the cloth was heated with steam at 120° C. for 8 minutes, followed by full washing with water and drying. A sufficiently deep, bright color image was produced on the cloth. The image was sharp without smudge in the ink-free white background.

EXAMPLE 11

By pad treatment (a pickup: 90%) with an aqueous solution containing 0.5% of a polyethylene oxide (Alcox E-75, trade name, molecular weight: 2,000,000 to 2,500,000), 2.0% of sodium sulfate and 5% of Alumina Sol-520, a 200 μm-thick polyester cloth was formed. The cloth contained 4.5% of alumina, 0.45% of polyethylene oxide and 1.8% of sodium sulfate. The cloth was cut to a 42 cm-width roll which was then subjected to full color printing as in Example 3. Immediately after the printing, a printed portion was cut out of the cloth and allowed to color with superheated steam at 180° C. for 5 minutes. Reductive washing was then carried out with an alkaline hydrosulfide-containing solution, followed by washing with water and drying. A sufficiently deep, bright image appeared on the cloth. The image was sharp without smudge in the ink-free white background. Also, there is no difference between color densities on both the front and back sides of the cloth and a sharp image could be obtained.

EXAMPLE 12

By pad treatment (a pickup: 90%) with an aqueous solution containing 2.0% of a polyethylene oxide (Alcox R-1000, trade name), 1% of urea, 6.0% of Alumina Sol-520 and 0.1% of tetrasodium salt of EDTA, a dry polyester cloth made of a new synthetic fiber class of polyester was prepared. The cloth contained 1.8% of polyethylene oxide, 0.9% of urea, 5.4% of alumina sol and 0.09% of tetrasodium salt of EDTA.

The procedure of Example 11 was followed in testing the cloth. A sufficiently deep, bright image appeared on the cloth. The image was sharp having no difference between image densities on both the front and back sides of the cloth without smudge in the ink-free white background and also at its back side.

EXAMPLE 13

A finely woven silk cloth was impregnated (a pickup: 70%) with an aqueous solution containing 4.0% of polyethylene oxide (Alcox R-400, trade name, molecular weight: 180,000 to 250,000), 3.0% of Alumina Sol-520 and 3% of urea. Contained in the cloth were 2.8% of polyethylene oxide, 2.1% of alumina sol and 2.1% of urea. The cloth was cut to an A3 size and multicolor printed as in Example 10.

Immediately after the printing, the cloth was heated with superheated steam at 102° C. for 8 minutes, followed by washing with water and drying. A highly deep, bright, uniform image appeared on the silk cloth. The image was sharp without smudge in the ink-free white background.

EXAMPLES 14 to 16

The procedure of Example 11 was followed except that the polyethylene oxide (Alcox E-75, trade name) was replaced with those resins listed in Table 2. The results are shown also in Table 2 together with those obtained for Comparative Example 4.

TABLE 2

| No. | Ingredient in Treating Solution | Sharpness | Color Depth |
|---|---|---|---|
| Example 14 | Alcox R-150 6% (molecular weight: $10 \times 10^4 - 17 \times 10^4$) | A | AA |
| Example 15 | Alcox R-1000 5% (molecular weight: $25 \times 10^4 - 30 \times 10^4$) | AA | AA |
| Example 16 | Alcox E-45 1% (molecular weight: $60 \times 10^4 - 80 \times 10^4$) | AA | AA |
| Comparative Example 4 | polyvinyl alcohol 2% alumina sol (boehmite) 4% | B | B |

EXAMPLE 17

A cotton cloth (thickness: 250 μm) was impregnated (a pickup: 80%) with an aqueous solution containing 1.0% of a polyethylene oxide (Alcox E-60, trade name, molecular weight: 1,000,000 to 1,200,000), 2.0% of sodium carbonate, 2.0% of N,N-dihydroxyethyl-p-toluene sulfonamide and 1.0% of Zebrun F-1 (tradename, fluorine type repellent, Ipposha Yushi K.K.), followed by drying, after which there was obtained a cloth according to the present invention. The cloth was severed to an A4 size and subjected to multicolor printing by a commercially available ink-jet color printer (BJC-820J, trade name, available from Canon Inc.) by use of the ink tested in Example 1.

Immediately after the printing, the cloth was heated with steam at 102° C. for 8 minutes, followed by full washing with water and drying. A sufficiently deep, bright color image was formed on the cotton cloth. The image was sharp without smudge in the ink-free white background. Further, color tone at mixed portions of two or more colors was sharp.

EXAMPLE 18

A 200 μm-thick polyester cloth was prepared by pad treatment (a pickup: 90%) with an aqueous solution containing 0.5% of a polyethylene oxide (Alcox E-75, trade name, molecular weight: 2,000,000 to 2,500,000), 2.0% of sodium sulfate, 2.0% of Palladium SS (paraffinic repellent, trade name, available from Ohara Palladium K.K.) and 2% of p-toluene sulfonamide.

The cloth was cut to a 42 cm-width roll which was then subjected to full color printing by a commercially available ink-jet color printer (BJC-440, trade name, available from Canon Inc.) and with use of the ink used in Example 3.

Immediately after the printing, a printed portion was cut out of the cloth and subjected to a fixing-treatment with superheated steam at 180° C. for 5 minutes. Reductive washing was thereafter conducted with a hydrosulfide-containing alkaline solution, followed by washing with water and drying.

A sufficiently deep, bright color image was produced on the polyester cloth. The image was sharp without smudge in the ink-free white background. Moreover, color shade was conspicuously bright at a region where two different colors had been mixed together.

EXAMPLE 19

A dry polyester cloth made by a new synthetic grade of polyester (filament thickness: 0.8 denier) was prepared by a pad treatment (a pickup: 90%) with an aqueous solution containing 2.0% of a polyethylene oxide (Alcox R-1000, trade name), 2.0% of a rosin sizing agent (Colopearl E-5H, tradename, 50% dispersion, available from Seiko Kagaku K.K.) and 6.0% of N-hydroxyethyl-p-toluene sulfonamide. Subsequent process steps were done as in Example 18.

A sufficiently deep, bright color image was produced on the polyester cloth. The image was sharp at its front and back sides without smudge in the ink-free white background. Marked brightness appeared particularly at a region where two colors had got admixed together.

EXAMPLES 20 to 22

The procedure of Example 19 was followed except that the polyethylene oxide (Alcox E-75, trade name) was replaced with those resins shown in Table 3. The results are tabulated also in Table 3.

TABLE 3

| No. | Ingredient in Treating Solution | Sharpness | Color Depth | Brightness at Two Colors-Mixed Region |
|---|---|---|---|---|
| Example 20 | Alcox R-150 7% (molecular weight: $10 \times 10^4$ $17 \times 10^4$) | B | AA | AA |
| Example 21 | Alcox R-1000 5% (molecular weight: $25 \times 10^4 - 30 \times 10^4$) | AA | AA | AA |
| Example 22 | Alcox E-45 1% (molecular weight: $60 \times 10^4 - 80 \times 10^4$) | AA | AA | AA |

According to the present invention, as stated above, images of high color depth and free from bleeding can be printed on cloth materials. The principles of the present invention may be applied as such to commercially available printers for office or personal use so that brightly deeply colored prints can be obtained. Also provided by the present invention is an ink-jet printing cloth which is capable of printing with sufficiently high color depth even at its back side.

What is claimed is:

1. A textile printing method comprising the steps of: applying an ink by an ink-jet system to an ink-jet printing cloth containing a polyethylene oxide having a viscosity average molecular weight of not less than 100,000 in an amount of from 0.1 to 30% by weight; subjecting the cloth to a fixing treatment; and washing and drying the cloth.

2. The textile printing method of claim 1, wherein the ink is a water-based ink.

3. The textile printing method of claim 1, wherein the ink comprises a reactive dye.

4. The textile printing method of claim 1, wherein the ink comprises a disperse dye.

5. A textile printing method comprising: incorporating in a cloth a polyethylene oxide having a viscosity average molecular weight of not less than 100,000 in an amount of from 0.1 to 30% by weight; applying to the resultant cloth an ink by an ink-jet system; subjecting the cloth to a fixing treatment; and washing and drying the cloth.

6. A textile printing method comprising the steps of: applying an ink by an ink-jet system to an ink-jet printing cloth containing a polyethylene oxide having a viscosity average molecular weight of not less than 100,000 in an amount of from 0.1 to 30% by weight, and a boehmite-based particulate alumina having an average primary particle size of 10 mμ to 20 mμ and a specific gravity of 1.17 to 1.20 in an amount of from 0.5 to 10% by weight; subjecting the cloth to a fixing treatment; and washing and drying the cloth.

7. The textile printing method of claim 6, wherein the ink is a water-based ink.

8. The textile printing method of claim 6, wherein the ink comprises a reactive dye.

9. The textile printing method of claim 6, wherein the ink comprises a disperse dye.

10. A textile printing method comprising: incorporating in a cloth a polyethylene oxide having a viscosity average molecular weight of not less than 100,000 in an amount of from 0.1 to 30% by weight, and a boehmite-based particulate alumina having an average primary particle size of from 10 to 20 mμ and a specific gravity of 1.17 to 1.20 in an amount of from 0.5 to 10% by weight; applying to the resultant cloth an ink by an ink-jet system; subjecting the cloth to a fixing treatment; and washing and drying the cloth.

11. A textile printing method comprising: incorporating in a cloth a polyethylene oxide the resin having a viscosity average molecular weight of not less than 100,000 in an amount of from 0.1 to 30% by weight, and a repellent in an amount of from 0.05 to 40% by weight; applying to the resultant cloth an ink by an ink-jet system; subjecting the cloth to a fixing treatment; and washing and drying the cloth.

12. The textile printing method of claim 11, further incorporating in the cloth a toluene sulfonamide derivative in an amount of from 0.2 to 20% by weight.

13. A textile printing method comprising the steps of: applying an ink by an ink-jet system to an ink-jet printing cloth containing a polyethylene oxide having a viscosity average molecular weight of not less than 100,000 in an amount of from 0.1 to 30% by weight, and a repellent in an amount of from 0.05 to 40% by weight; subjecting the cloth to a fixing treatment; and washing and drying the cloth.

14. The textile printing method of claim 13, wherein the ink-jet printing cloth further contains a toluene sulfonamide derivative in an amount of from 0.2 to 20% by weight.

15. The textile printing method of claim 13 or claim 14, wherein the ink is a water-based ink.

16. The textile printing method of claim 13 or claim 14, wherein the ink comprises a reactive dye.

17. The textile printing method of claim 13 or claim 14, wherein the ink comprises a disperse dye.

* * * * *

UNITED STATES PATENT AND TRADEMARK OFFICE

CERTIFICATE OF CORRECTION

PATENT NO. : 5,781,216

DATED : July 14, 1998

INVENTORS : MASAHIRO HARUTA, ET AL.

It is certified that error appears in the above-identified patent and that said Letters Patent is hereby corrected as shown below:

COLUMN 1,
Line 12, "has" should read --have--.

COLUMN 2,
Line 22, "provide" should read --provides--.

COLUMN 3,
Line 35, "exceed" should read --exceeds--; and
Line 46, "an" should read --a--.

COLUMN 4,
Line 18, "achieving" should read --achieve--.

COLUMN 5,
Line 19, "polyetylene" should read --polyethylene--.

COLUMN 10,
Compound 10, "X" should read --X- --; and
Line 58, "as the" should read --an--.

COLUMN 11,
Line 51, "can" should read --can be--.

UNITED STATES PATENT AND TRADEMARK OFFICE

CERTIFICATE OF CORRECTION

PATENT NO. : 5,781,216

DATED : July 14, 1998

INVENTORS : MASAHIRO HARUTA, ET AL.

It is certified that error appears in the above-identified patent and that said Letters Patent is hereby corrected as shown below:

COLUMN 15,
Line 53, "0.5$" should read --0.5%--.

COLUMN 18,
Line 23, "got" should read --gotten--; and
Line 38, "$10x10^4 17x10^4$" should read --$10x10^4$-$17x10^4$--.

Signed and Sealed this

Eighteenth Day of May, 1999

*Attest:*

Q. TODD DICKINSON

*Attesting Officer*

*Acting Commissioner of Patents and Trademarks*